US005921221A

United States Patent [19]

Davis, Jr. et al.

[11] Patent Number: 5,921,221

[45] Date of Patent: Jul. 13, 1999

[54] METHOD OF CONTROLLING CYCLIC VARIATION IN ENGINE COMBUSTION

[75] Inventors: Leighton Ira Davis, Jr., Ann Arbor, Mich.; Charles Stuart Daw, Knoxville, Tenn.; Lee Albert Feldkamp, Plymouth, Mich.; John William Hoard, Livonia, Mich.; Fumin Yuan, Canton, Mich.; Francis Thomas Connolly, Ann Arbor, Mich.

[73] Assignees: Ford Global Technologies, Inc.; Ford Motor Company, both of Dearborn, Mich.; Lockheed Martin Energy Research Corp., Oak Ridge, Tenn.

[21] Appl. No.: 09/075,291

[22] Filed: May 8, 1998

Related U.S. Application Data

[51] Int. Cl.[6] ..... F02M 7/00

[52] U.S. Cl. ..... 123/436; 123/335; 123/406.24; 701/105; 701/111

[58] Field of Search ..... 123/419, 436, 123/339.19, 406.24, 335; 701/111, 105

[56] References Cited

U.S. PATENT DOCUMENTS

| | | | |
|---|---|---|---|
| 4,346,625 | 8/1982 | Latsch et al. | 477/110 |
| 4,532,592 | 7/1985 | Citron et al. | 701/105 |
| 4,919,099 | 4/1990 | Extance et al. | 123/406.28 |
| 5,720,260 | 2/1998 | Meyer et al. | 123/436 |

OTHER PUBLICATIONS

"A Dynamical Instability Of Spark–Ignited Engines", by Jeffrey C. Kantor, Science, vol. 224, Jun. 15, 1984, pp. 1233–1235.

"The Influence of Arc Parameters on Combustion In A Spark–Ignition Engine", by M.S. Hancock et al, SAE Technical Paper No. 860321, Feb. 24–28, 1986, pp. 1–9.

"Cycle–to–Cycle Variations: A Chaotic Process?", by John W. Daily, Combust. Sci. & Tech., 1988, vol. 57, pp. 149–162.

"A Major Origin Of Cyclic Energy Conversion Variations In SI Engines: Cycle–by–Cycle Variations Of The Equivalence Ratio and Residual Gas of the Initial Charge", by G. Grunefeld et al, SAE Technical Paper No. 941880, Oct. 17–20, 1994, pp. 1–12.

"The Impact of Combustion Phasing on Cycle–by–Cycle Performance of a Spark Ignition Engine", by S.P. Stevens et al, SAE Technical Paper No. 950687, Feb. 27–Mar. 2, 1995, pp. 1–13.

"A Simple Model for Cyclic Variations in a Spark–Ignition Engine", by C.S. Daw et al, SAE Technical Paper No. 962086, Oct. 14–17, 1996, pp. 1–10.

*Primary Examiner*—Tony M. Argenbright
*Assistant Examiner*—Mahmoud M. Gimie
*Attorney, Agent, or Firm*—Allan J. Lippa; Roger L. May

[57] ABSTRACT

Cyclic variation in combustion of a lean burning engine is reduced by detecting an engine combustion event output such as torsional acceleration in a cylinder (i) at a combustion event (k), using the detected acceleration to predict a target acceleration for the cylinder at the next combustion event (k+1), modifying the target output by a correction term that is inversely proportional to the average phase of the combustion event output of cylinder (i) and calculating a control output such as fuel pulse width or spark timing necessary to achieve the target acceleration for cylinder (i) at combustion event (k+1) based on anti-correlation with the detected acceleration and spill-over effects from fueling.

10 Claims, 8 Drawing Sheets

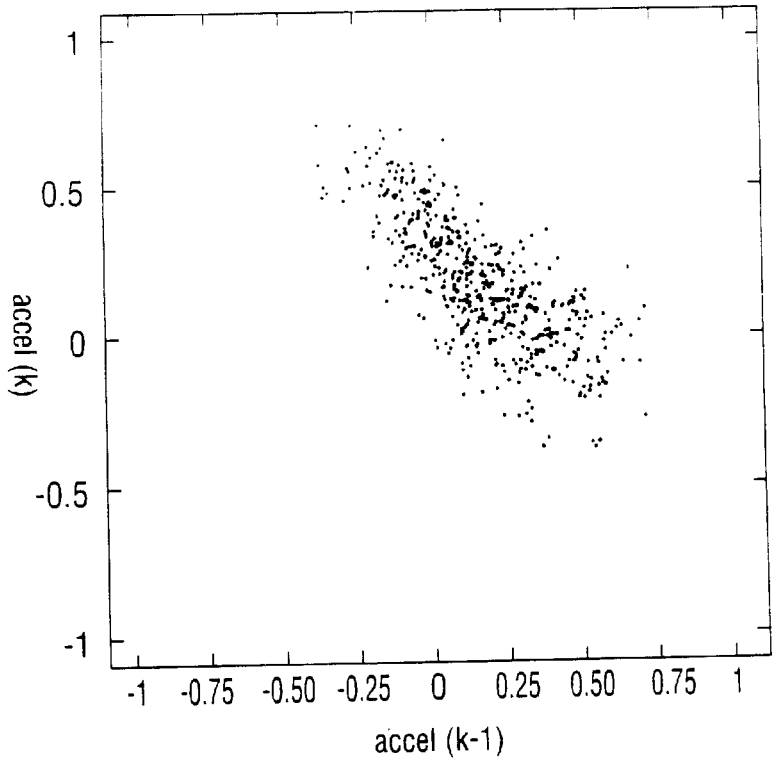
Fig. 1
Fig. 9
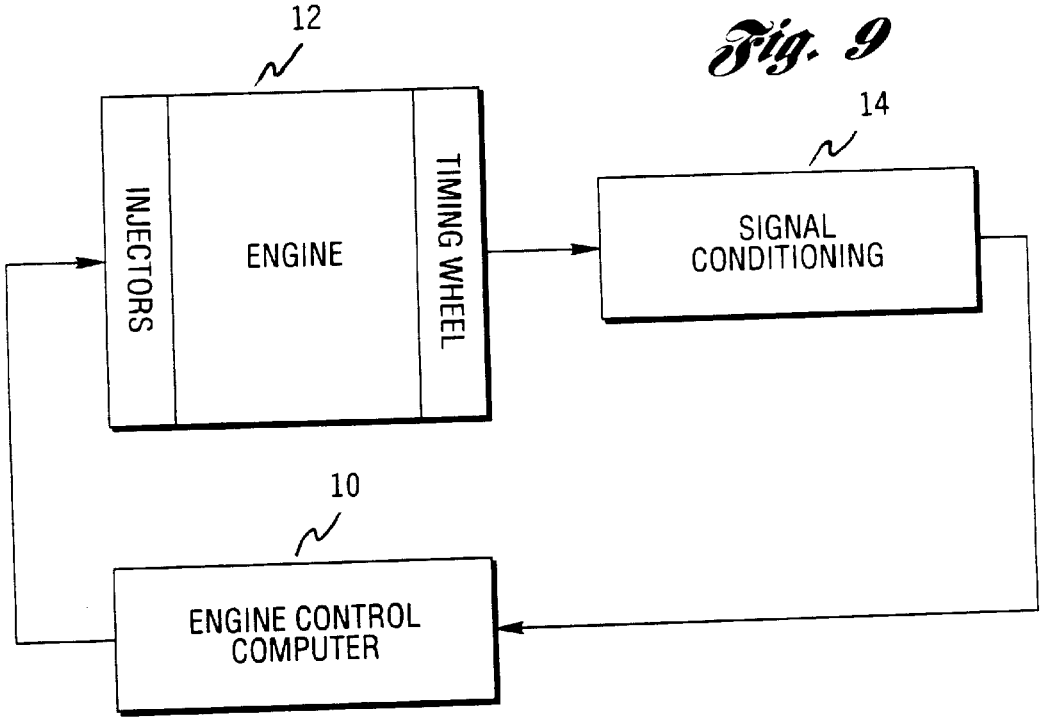

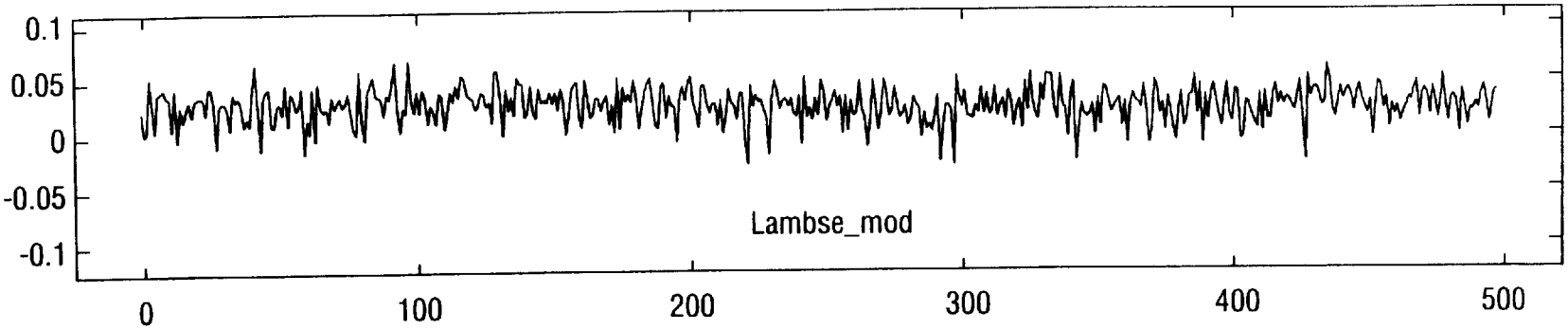
Fig. 5
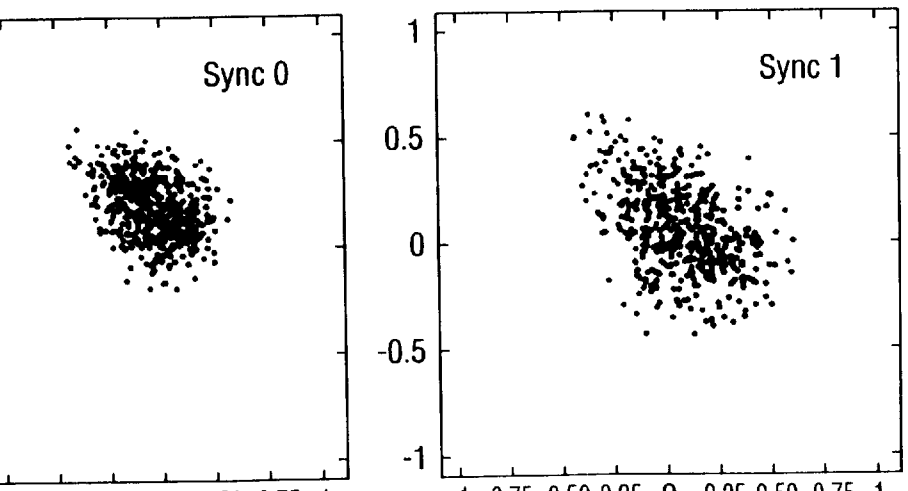
Fig. 5a
Fig. 5b
Fig. 5c

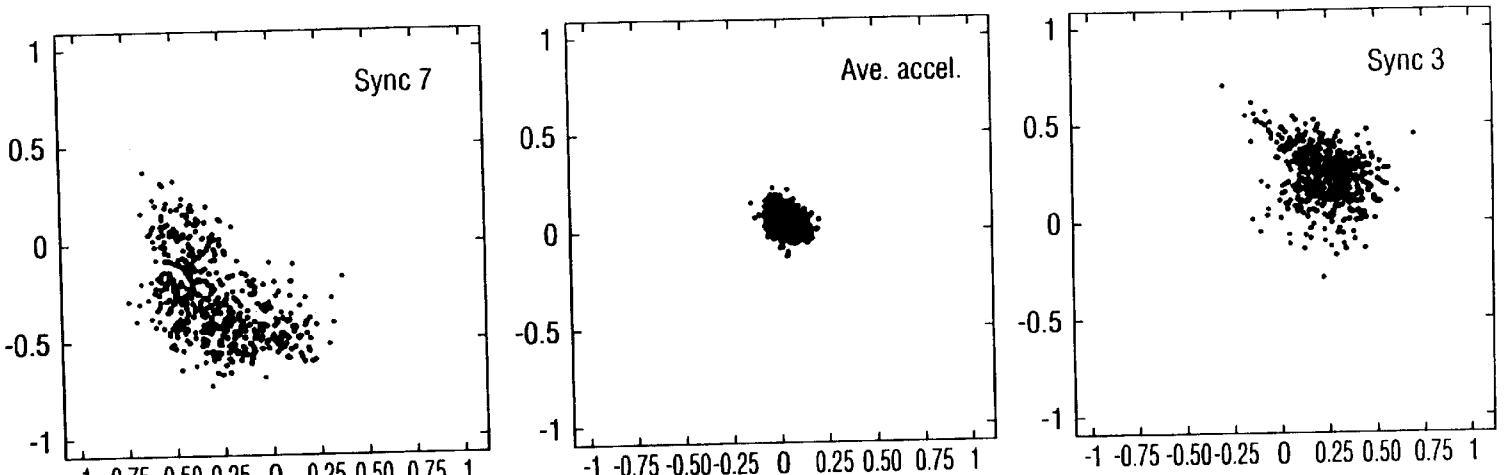
Fig. 5b
Fig. 5e
Fig. 5f
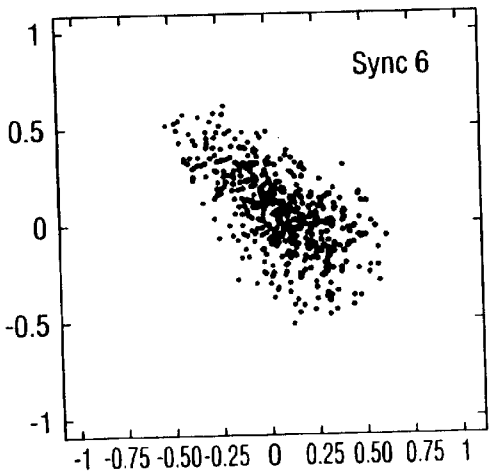
Fig. 5g
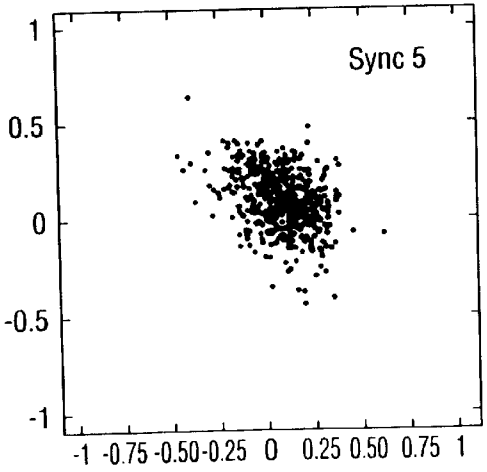
Fig. 5h
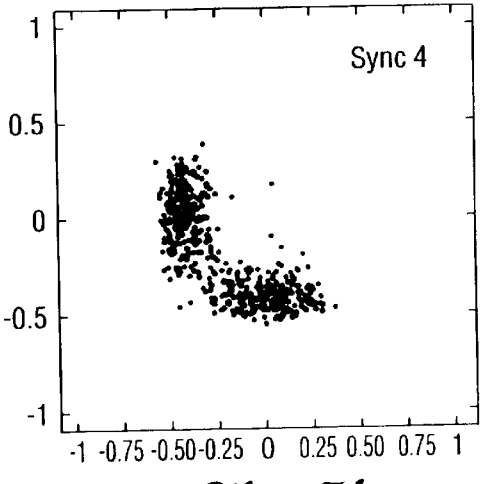
Fig. 5i

METHOD OF CONTROLLING CYCLIC VARIATION IN ENGINE COMBUSTION

STATEMENT REGARDING FEDERALLY SPONSORED RESEARCH OR DEVELOPMENT

The United States Government has rights in this invention pursuant to Contract No. DE-AC0596OR22464 between the United States Department of Energy and Lockheed Martin Energy Research Corporation.

TECHNICAL FIELD

This invention relates to engine control systems and more particularly to a method of reducing cyclic variations in engine combustion.

BACKGROUND OF THE INVENTION

The existence of cyclic variability in the quality of combustion in spark-ignited, internal combustion engine has long been recognized. Such variations can be particularly severe for lean air-fuel mixtures, i.e., when the ratio of air to fuel is greater than that implied by chemical stoichiometry. The analysis of these variations is made difficult by the existence of several possible mechanisms which could act separately or in concert. One problem is the variations in the delivery of air and fuel into the cylinder. The effect of variations either in mass of fuel or its distribution would tend to be exacerbated under lean conditions, when the total mass of fuel is relatively smaller. It is recognized that the fluid dynamic effects during engine intake and exhaust strokes are dominant contributors in cyclic variations. The importance of the residual gas, both content and amount, has also been recognized and is generally regarded as the cause of the frequently observed alternating pattern of high and low work output cycles, although other mechanisms have been proposed. Investigators have considered cyclic variations from the standpoint of understanding the mechanism well enough to effect a reduction in the variation by imposing control. They found that significant correlation exists between consecutive firings of a particular cylinder, and that various relevant measurable quantities, such as indicated mean effective pressure, are subject to reasonable prediction one cycle in advance. Various means of imposing control, such as through changes of spark timing and fuel delivery have been considered.

Because the combustion process depends on several state variables and is nonlinear, it is a candidate for exhibiting the complex behavior called deterministic chaos, or just chaos for short. If chaotic behavior takes place in a system with many important state variables (e.g., more than ten), it is termed high-dimensional chaos. While high dimensional chaos is in principle deterministic, it is usually so complex that as a practical matter (at least with current understanding), it can only be treated with methods applicable to stochastic (random) systems. Hence to be of present practical importance, e.g., for better fundamental understanding or real-time control of a physical system, it is necessary for the identified chaotic behavior to be low -dimensional, (e.g., have a number of important state variables that is less than ten).

The possibility of chaotic behavior in spark ignited engines was suggested at least as far back as 1984 and has been a continuing source of investigation. Chew et al. claim to have identified chaotic behavior in a production internal combustion engine, though they are not rigorous in distinguishing their observations from stochastic behavior.

Further, they do not discuss implications for practical application of their findings. Finney, Nguyen, and Daw (Japanese Combustion Symposium, Sendai, 1994) make use of chaotic time series analysis to analyze data from a one-cylinder engine, concluding that the variations observed are not consistent with purely random behavior and hence that short-term predictability might be possible.

In an attempt to explain how residual gas affects could lead to nonlinear deterministic coupling between cycles, Daw et al. developed a simple model for variations of fuel and air in an engine cylinder:

$$m(i+1)=m(i)*(1-CE)*F+(1-F)*[MF+\delta MF(i)]$$

$$a(i+1)=[a(i)-R*CE*m(i)]*F+(1-F)*AF$$

where the main variables are defined as:

m(i)=mass of fuel before ith burn a(i)=mass of air before ith burn

δMF(i)=small change in mass of fresh fuel per cycle, dictated by control;

constant, or slowly varying variables are:

MF=mass of fresh fuel per cycle

AF=mass of fresh air fed per cycle;

parameters whose values are indicated by engine or fuel characteristics are:

F=fraction cylinder gas remaining

R=stoichiometric air-fuel ratio, ~14.6;

and a key variable which may, for example, be a function of air-fuel ratio:

CE=combustion efficiency of ith burn.

With no control imposed (δMF(i)=0) and no stochastic perturbation of the parameters, this model exhibits unstable behavior in the form of period-doubling and chaotic behavior at lean conditions, depending on particular values of the variables and parameters and the functional form and characteristics of CE. Given simple functional forms for CE, the equations may be solved for fixed points in the variables, i.e., values where the behavior is at least marginally stable, and a control equation may be developed that will force the system to a fixed point and keep it there. For practical application, the functional form of CE is not known a priori and must be developed from heuristic arguments and experience. Nevertheless, it is expected from combustion physics that the functional form of CE includes a strong nonlinear dependence of combustion efficiency on the in-cylinder fuel and air content at the time of the burn.

The initial period-2 bifurcation of the uncontrolled model represents a condition where the fixed point becomes unstable due to the effect of the nonlinearity. The bifurcation is physically explained by considering that the residual mass fraction for a slow burn or partial misfire enhances the fuel-air ratio for the next burn. Similarly, a strong burn will leave no fuel in the residual gas, leading to the possibility of a leaner than average mixture and lower output for the next burn. Near stoichiometry, such small changes would have little impact, but as the strongly nonlinear lean combustion boundary is approached, small changes in cylinder inventory produce large consequences. When the alternating strong and weak burns occur, it is expected to appear as an anti-correlation in the time series of combustion indices such as heat release and IMEP.

Additionally, there is considerable uncertainty or noise associated with the combustion process. Such noise can be described in terms of stochastic (typically Gaussian) variations in the model parameters. The model nonlinearities amplify the effect of these stochastic variations, and the tendency to go into oscillations and chaos is increased. Although the presence of such noise complicates the cyclic variation patterns, their global features continue to be dominated by the characteristics of the unperturbed nonlinear system.

Because the effects of the nonlinear determinism continues to dominate even in the presence of noise, an adaptive control approach of the following form can be used to reduce cyclic variations:

$$\delta MF(i)=\text{Gain}*(CE(i)-tgtCE(i))$$

$$tgtCE(i+1)=tgtCE(i)+\text{scalar}*\delta MF(i)$$

where:

$tgtCE$=desired or target $CE$ and Gain and scalar are parameters to be determined experimentally. This approach may also work when CE is not available but there is some quantity that is well correlated with it, such as heat release or acceleration:

$$\delta MF(i)=\text{Gain}*(\text{accel}(i)-tgt\text{accel}(i))$$

$$tgt\text{accel}(i+1)=tgt\text{accel}(i)+\text{scalar}*\delta MF(i)$$

where:

$tgt$accel=desired or target accel.

In controlled test cell experiments with an eight-cylinder, 4.6L, 2-valve engine it has been demonstrated that the general patterns predicted by the above simple model are actually produced under lean fueling conditions (Daw et al.,). Specifically, dynamic combustion variations in standard indicators such as heat release and IMEP were monitored over several thousand cycles by recording and processing the in-cylinder pressure. Analyzing these data with techniques from chaotic time series analysis (e.g., time delay embedding and return maps), provided strong evidence that the combustion becomes unstable with increasingly lean operation via a period-2 bifurcation sequence that leads to alternating low- and high-power strokes. This bifurcation pattern is clearly visible in test cell measurements in spite of the stochastic parameter perturbations that are known to be occurring in the experiments. At extremely lean fueling it appears that the engine becomes fully chaotic, although this condition is so erratic it would not seem to be of interest for passenger automobiles. As predicted by the model, increases in the magnitude of the stochastic inputs tends to accelerate the onset of the bifurcations (i.e., they begin to occur at higher equivalence ratios). Comparisons of experimental return map patterns with model predictions show strong similarities that confirm the basic correctness of this model (see FIGS. 9–12, Daw et al.,).

SUMMARY OF THE INVENTION

The present invention is based on a recognition that the dominant combustion instability arises from nonlinear bifurcations near the lean limit. This knowledge is exploited to identify when the instability begins to develop and how it can be countered with feedback perturbations. By recognizing the deterministic component in combustion variations at lean conditions, the present invention reduces the instability with explicit and simple real-time control algorithms thus minimizing computational complexity and overhead. The nonlinear sensitivity of the combustion to small changes in parameters such as fuel injection pulse width or spark timing allows effective control with very small control inputs making it possible to improve engine operation with little or no net change to time average parameter values.

In accordance with a preferred embodiment of the invention cyclic variation in combustion of a lean burning engine is reduced by detecting an engine combustion event output such as torsional acceleration in a cylinder (i) at a combustion event (k), using the detected acceleration to predict a target acceleration for the cylinder at the next combustion event (k+1), modifying the target output by a correction term that is inversely proportional to the average phase of the combustion event output of cylinder (i) and calculating a control output such a fuel pulse width necessary to achieve the target output for cylinder (i) at combustion event (k+1) based on anti-correlation with the detected output and spillover effects from fueling.

BRIEF DESCRIPTION OF THE DRAWINGS

FIG. 1 is a plot of the acceleration of a particular cylinder versus the acceleration for that cylinder's prior combustion event and referred to as a phase plot;

FIG. 2*i* is a phase plot of the average acceleration of the eight cylinders;

FIG. 5 is a plot of the fuel control modification performed by the present invention while FIG. 5*a*–5*h* are phase plots showing the reduction, when compared to FIGS. 2*a*–2*h*, in anti-correlation and overall variations in acceleration resulting from applying the control shown in FIG. 5;

FIG. 9 is a block diagram of an engine control system for implementing the method of the present invention;

DETAILED DESCRIPTION OF PREFERRED EMBODIMENT

Figure 2A:
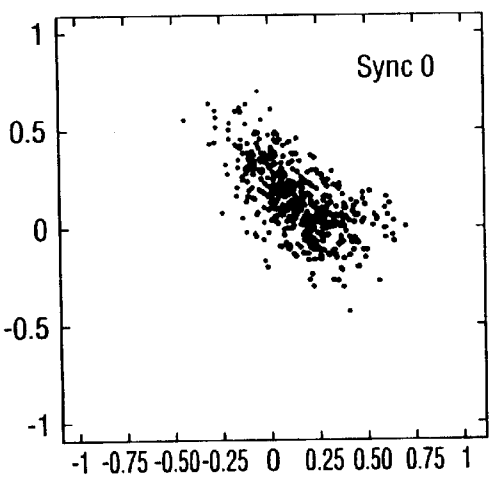
FIGS. 2*a*–2*h* are phase plots showing the anti-correlation present on all eight cylinders of an engine when the control method of the present invention is not applied.
Figure 2B:
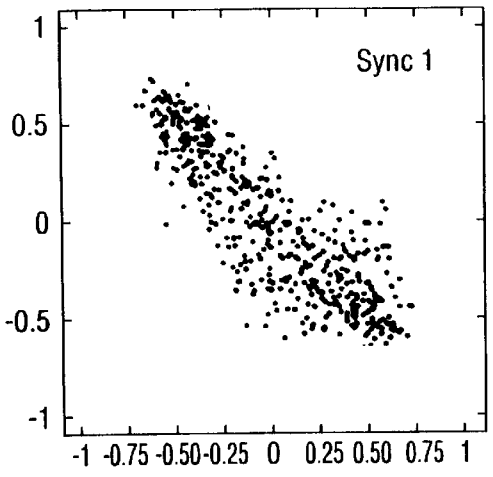
Figure 2C:
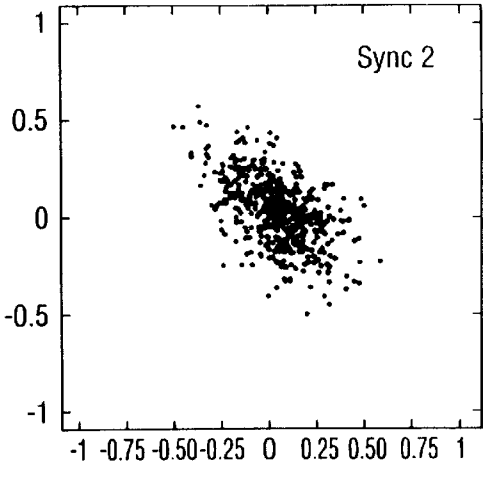
Figure 2D:
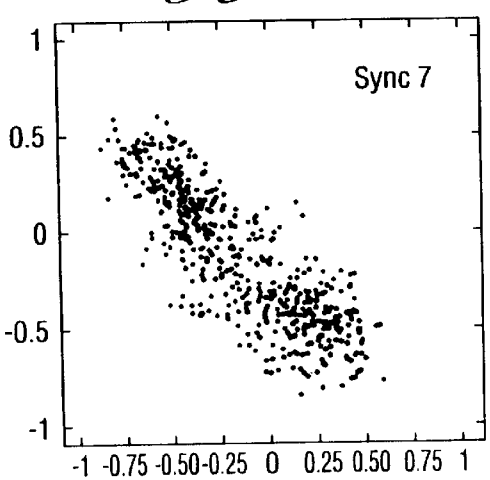
Figure 2E:
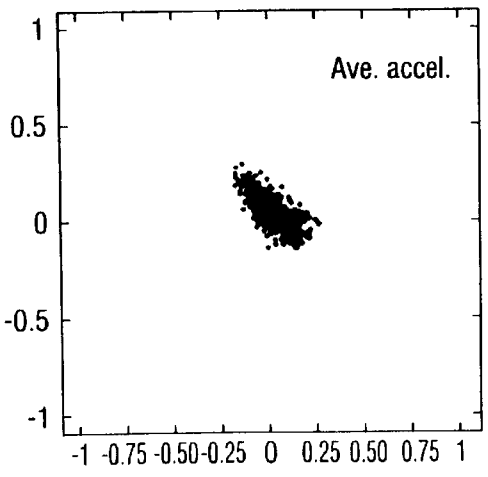
Figure 2F:
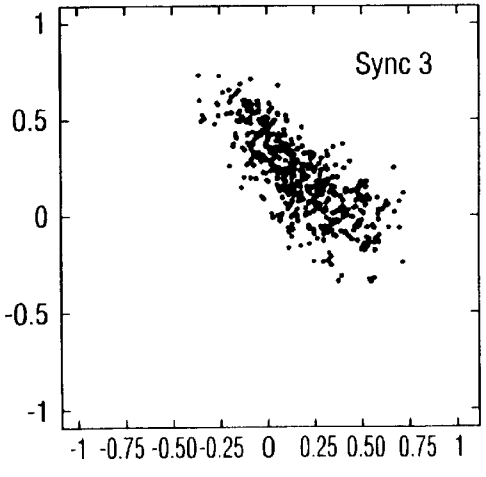
Figure 2F:
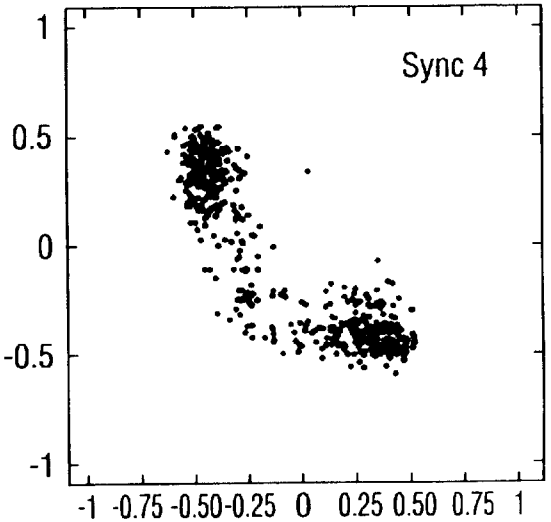
Figure 2G:
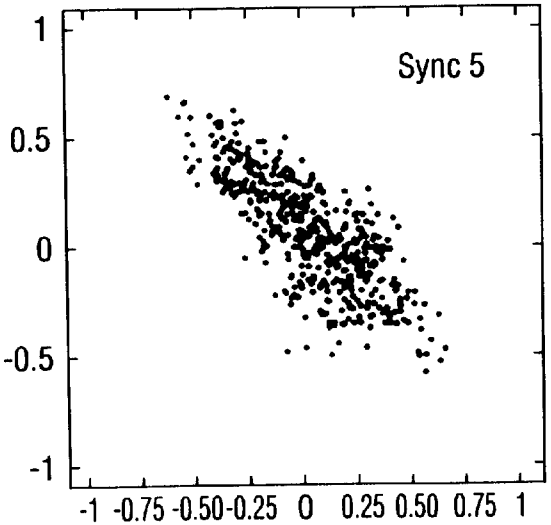
Figure 2H:
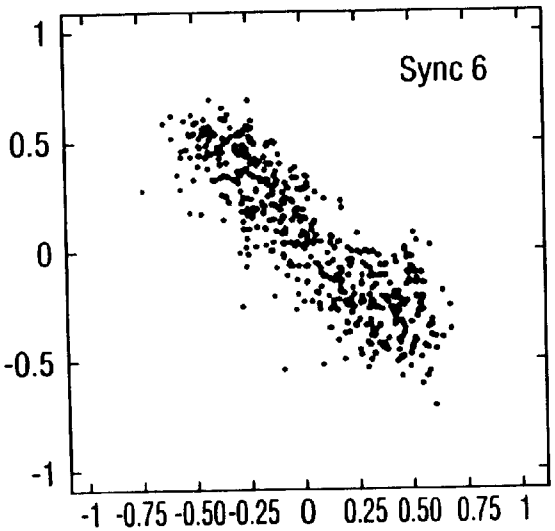

Referring now to the drawings and initially to FIG. 1, a plot of the acceleration associated with a particular cylinder versus the acceleration associated with the prior combustion event of that cylinder, is shown. The plot indicates a definite anti-correlation between consecutive combustion events on the same cylinder. The data for the plot was obtained from an eight cylinder 4.6L 2-valve engine on a 1994 vehicle operating under lean conditions (LAMBSE @ 1.3). The anti-correlation is indicated by a distribution of the points spread out along a negative slope, indicating a tendency for the accelerations to alternate back and forth between relatively large and small values. For operation under more usual conditions of stoichiometry (LAMBSE @ 1.0), no anti-correlation or other pattern is seen in such plots; rather the distribution is spread in a uniform and symmetric blob.

Because in-cylinder pressure transducers were not available on this test vehicle (as is the case for almost all current passenger automobiles), engine torsional acceleration was used as an indicator of combustion event energy output. Engine torsional acceleration was derived from standard timing interval measurements (PIP interval) available in the electronic engine control (EEC) computer on the vehicle.

The anti-correlation between successive burns at lean conditions is a manifestation of the bifurcation indicative of combustion instability. Even though torsional acceleration measurements are less accurate than more direct combustion indicators derived from in-cylinder pressure measurements, such measurements are quite adequate for detecting the onset of combustion bifurcations in an automobile. As shown in FIGS. 2*a*–2*h*, the anti-correlation is evident on all eight cylinders for lean conditions (LAMBSE=1.3) and low (400 to 700) rpm. The individual plots are identified by Sync number which is the firing order or fueling order so each occurs sequentially in time as opposed to the cylinder numbers which follow a different time pattern.

In accordance with the present invention reduction in anti-correlation takes the following approach: if the current acceleration is low, anticipate that the next will be high and do something—such as reducing fuel—to reduce it. Similarly, if the current acceleration is high, increase the fuel for that cylinder's next event. However, this approach does not serve to reduce overall cycle to cycle variations if it is applied without further consideration. As the application of control increases, the amount of variation in cylinder accelerations changes but the minimum occurs for no control. There are two complications that must be considered for practical application of this approach. One has to do with the observation that changing the fuel for one cylinder may affect others i.e. a spillover effect from cylinder to cylinder must be taken into account to assure correct fueling. The other complication is due to the positive feedback nature of the approach i.e. if the phasing of the control for all of the individual cylinders happens to line up within a cycle, the next cycle will reverse this and so forth, leading to a cycle-to-cycle oscillation. Both of these effects imply that the control of each cylinder must be properly coordinated with respect to the others.

Figure 3:
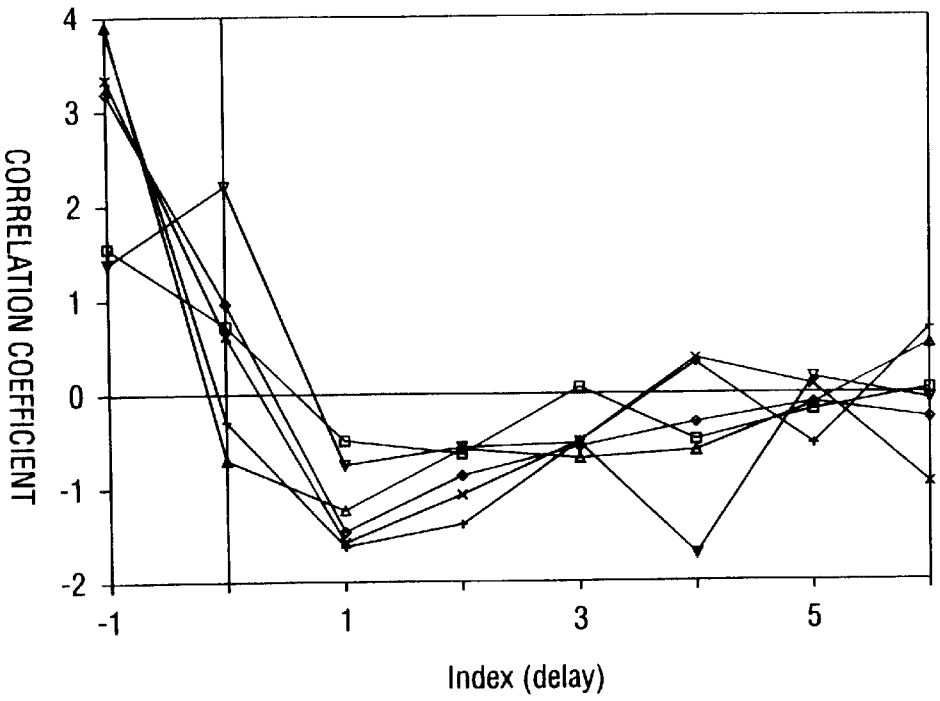
FIG. 3 is a plot of Correlation Coefficient vs. Cylinder Index (synchronization delay) and shows the degree that variations in fuel in one cylinder is correlated with acceleration from subsequent cylinders.

FIG. 3 shows the effect that varying fuel in one cylinder has on subsequent cylinders. Traces are shown, for six of the eight engine cylinders. Each point represents the correlation between LAMBSE variation that nominally affects the acceleration of cylinder (i) and the acceleration on other cylinders (i+j). All the cylinders follow a similar pattern, so the average response is a reasonable simplification. Given that for particular operating conditions of the engine there is anti-correlation in cylinder accelerations, a cylinder's next acceleration is predictable based on its previous acceleration. Its acceleration will also depend on the fuel charge about to be given it and, due to spillover effects, the fuel just given other cylinders (i–j). Thus, the acceleration in cylinder (i) at combustion event (k+1) may be predicted by:

$$\begin{aligned}\text{accel}_i(k+1) = \alpha\ \text{accel}_i(k) + \beta_i\ \delta lmb_i(k+1) + \beta_{i-1}\ \delta lmb_{i-1}(k) + \\ \beta_{i-2}\ \delta lmb_{i-2}(k) + \beta_{i-3}\ \delta lmb_{i-3}(k) + \beta_{i-4}\ \delta lmb_{i-4}(k) + \\ \beta_{i-5}\ \delta lmb_{i-5}(k) + \beta_{i-6}\ \delta lmb_{i-6}(k) + \beta_{i-7}\ \delta lmb_{i-7}(k)\end{aligned}$$

where:

$\alpha$ is the correlation coefficient for subsequent accelerations on the same cylinder (negative for anti-correlation), $\beta_{i-j}$ is the correlation between the i-th acceleration and the (i–j)th change in LAMBSE, $\delta lmb_{i-j}(k)$, and (k) refers to the cycle that has just passed, (k+1) to the cycle just ahead.

For our experiments at an average LAMBSE value of 1.3 and low (400 to 700) rpm, we used a value of −0.9 for $\alpha$ and $\beta_{i-j}$ obtained from the average response of FIG. 3. For any cylinder for which we wish to determine $\delta lmb_i$ (k+1), we have the previous acceleration, $\text{accel}_i$ (k), all the $\delta lmb_{i-1}$ (k)'s we have produced leading up to the moment, and the target acceleration, $\text{accel}_1$ (k+1), we wish to attain. The equation may then be solved for $\delta lmb_i$ (k+1), the next fuel change to give cylinder (i).

Figure 4:
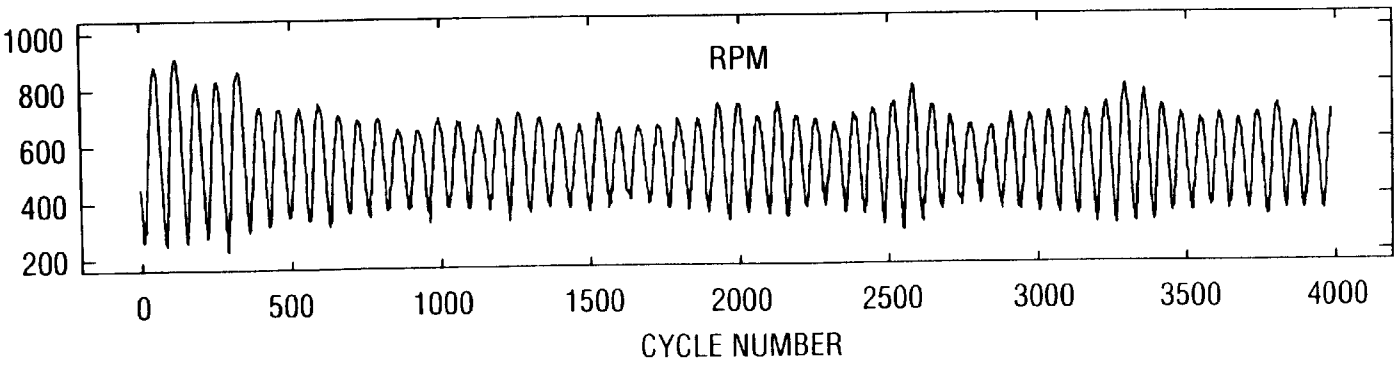
FIG. 4 shows the cycle to cycle oscillations in RPM that occur if the phase of accelerations between individual cylinders is ignored.

To compensate for the potential deleterious effects of individual cylinder positive feedback, it is necessary to apply negative feedback. The extent of coordination between individual cylinder accelerations may be monitored by looking at the phase of acceleration (the difference between the current acceleration and a running average of accelerations) averaged over the past eight events. Applying a modification to LAMBSE inversely proportional to this phase is effective in suppressing cycle to cycle oscillations. If this modification is neglected, FIG. 4 shows the oscillations that may result.

Figure 6:
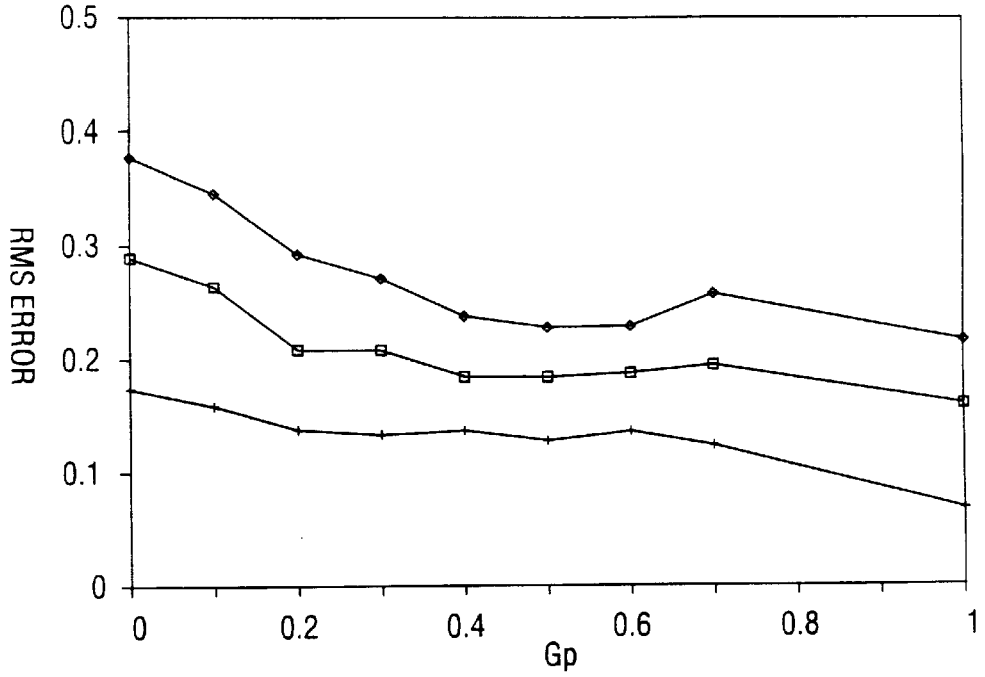
FIG. 6 shows how the overall variation in acceleration changes with Gp.
Figure 7:
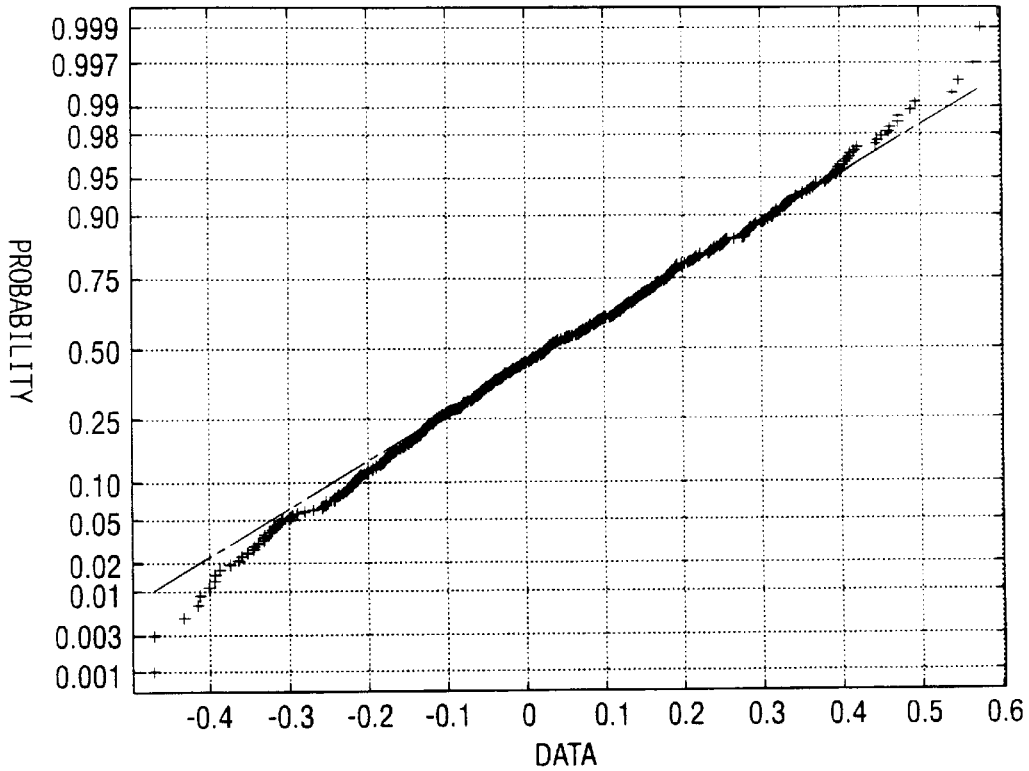
FIGS. 7 and 8 show the distribution of accelerations (for cylinder synchronization index 2) with and without the control method of the present invention.
Figure 8:
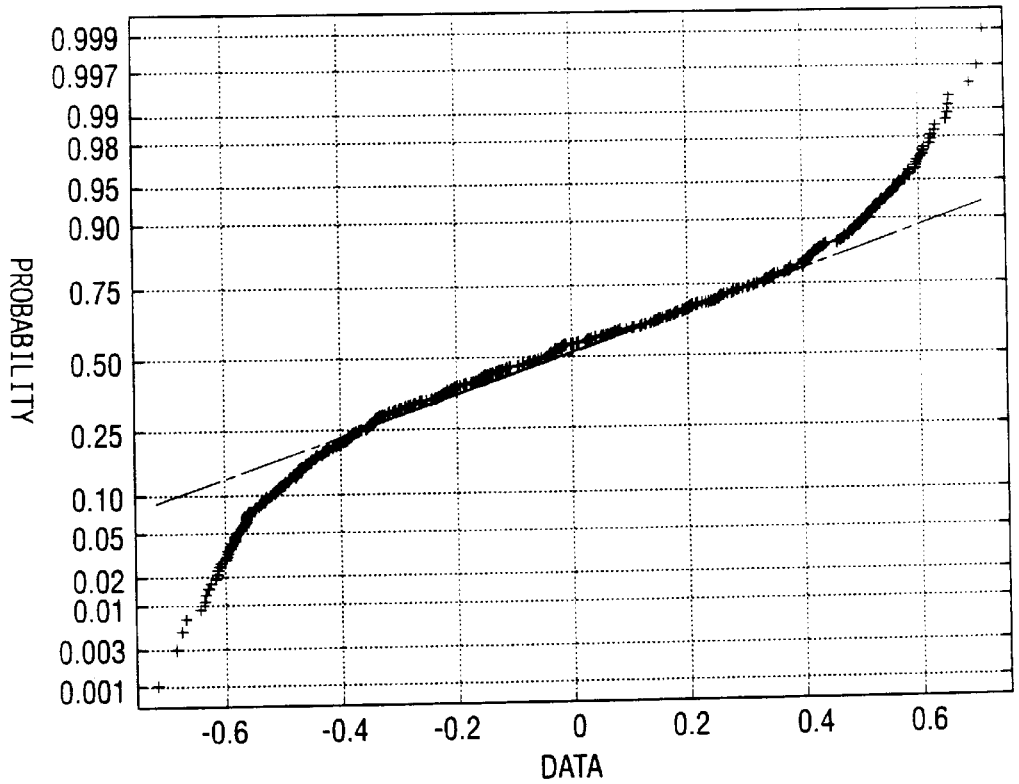

Combining individual cylinder positive feedback with compensation for cylinder spillover effects and negative feedback on phase results in reducing overall variations in accelerations as well as anti-correlation. Comparing FIG. 5 to FIG. 2, we see a noticeable reduction in anti-correlation and overall variations in acceleration resulting from applying a certain level (Gp=0.4) of this control. FIG. 6 shows how the overall variations in acceleration change with Gp. Although the minimum variation occurs for Gp=1.0, that level of gain is not particularly stable: the reduction in variation occurs because some cylinders misfire completely. The top curve is the maximum RMS variation for any cylinder for a particular Gp. The bottom curve is the minimum RMS variation for any cylinder for the Gp indicated. The middle curve is the average RMS variation for all cylinders for the Gp indicated. FIGS. 7 and 8 indicate by probability plots of the acceleration data in FIGS. 5 and 2 respectively, the distribution of accelerations (for cylinder synchronization index 2) with and without control. The degree to which the data lies along the straight line indicated on FIG. 7, the data may be considered near normal or Gaussian distribution. Without the control of the present invention the data for the same cylinder is similarly plotted in FIG. 8. It will be observed that at the ends of the plotted data departs from the normal distribution and this is the result of anti-correlation. Thus, the effect of the control scheme of present invention is to change an almost bimodal distribution as shown in FIG. 8 to one that is near Gaussian in FIG. 7.

Figure 10:
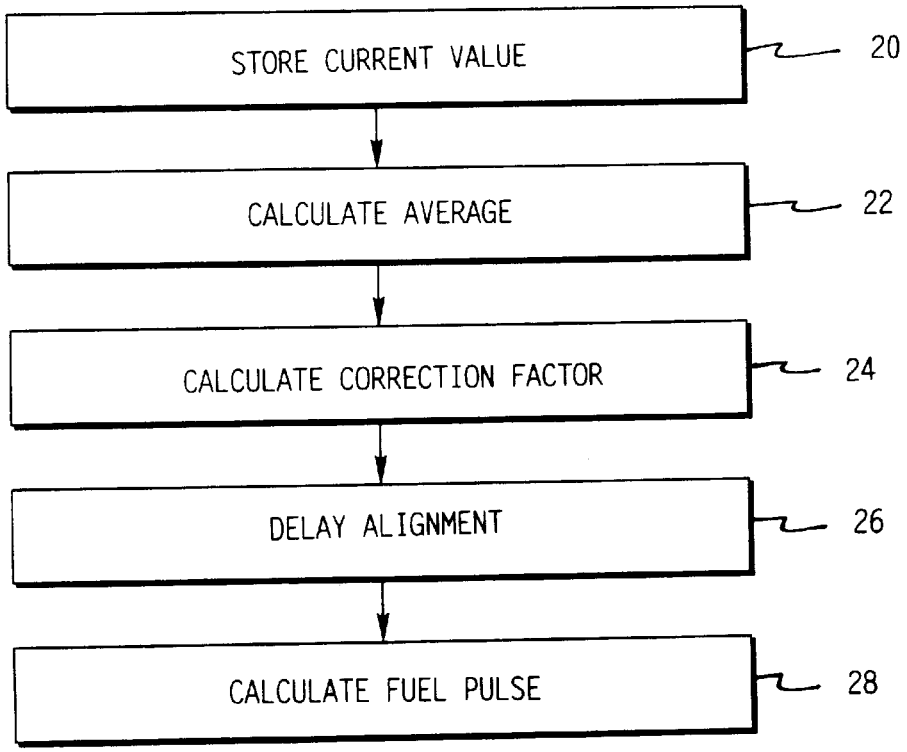
FIG. 10 is a flow chart of the steps of the method of present invention.

Referring now to FIGS. 9 and 10 the method of the present invention is implement by an electronic engine control (EEC) computer 10 which responds to input data from the timing wheel of an engine 12 after signal conditioning at 14 and provides fuel control pulses to individual injector of the engine. Engine torsional acceleration is calculated in the computer 10 using standard timing interval measurements (PIP interval) obtained from the timing wheel.

As indicated in the flowchart, lambse control calculations are performed each combustion event at cylinder (i) at combustion event (k) and stored in a circular buffer (j).

Current acceleration values are determined and stored at 20 in accordance with the following equation:

$$curr_accel = accel_i(k)$$

Average acceleration values are calculated at block 22 in accordance with the following equations:

$$targ_i(k) = targ_i(k-1) + 0.015[accel_i(k) - targ_i(k-1)]$$

$$accel_avg(k) = accel_avg(k-1) + 0.15[curr_accel - accel_avg(k-1)$$

The fuel control modification factors are calculated at block 24 in accordance with the following equations:

$$targ_mod(k) = -2.0 accel_avg(k)$$

$$prev_lmod(k) = lambse_mod(k-1)$$

$$lambse_mod(k) = 0.357Gp\left[targ_i(k) + targ_mod(k) + \alpha curr_accel + \sum_j \beta_j lmod_j(k-1)\right]$$

The above equation for targ_mod(k) is the negative feedback used to compensate for the potential cycle to cycle oscillation and is included in the lambse_mod(k) predicative control equation as an addition to $tarq_i(k)$.

In the block 24 the circular buffer indexed by (j) is cycled and the new value is inserted as indicated by the following equations:

$$lmod_j(k) = lmod_{j-1}(k-1); j = 2-8$$

$$lmod_1(k) = lambse_mod(k)$$

In block 26 an alignment delay is calculated for the current lambse to take into account the time delay between the calculation of the fuel pulse for a particular cylinder and application of that pulse to the cylinder as indicated in the following equation:

$$lambse(k) = lambse_targ + prev_lmod(k)$$

In the equation prev_lmod(k) implies a delay of one but is arbitrary and could be a delay of 0 to 7 depending on the engine.

The fuel pulse for a particular cylinder indexed by (i) is calculated in block 28 in accordance with the following equation:

$$fuel_pulse_i(k) = cyl_air_charge/((STOICH)(lambse(k)))$$

On average, prev_lmod is small if not zero so that LAMBSE is not changed significantly but rather is altered up and down a small amount. Accordingly, the average fuel consumption and emissions are not increased by using the method of the present invention.

While the best mode for carrying out the present invention has been described in detail, those familiar with the art to which this invention relates will recognize various alternative designs and embodiments for practicing the invention as defined by the following claims.

What is claimed is:

1. A method of reducing cyclic variation in engine combustion when the air-fuel mixture is at or lean of stoichiometry, comprising a sequence of the steps of:

detecting an engine combustion event output in cylinder (i) at a combustion event (k);

determining a target output for cylinder (i) at a combustion event (k+1) based on the detected output in cylinder (i) at combustion event (k);

modifying the target output for cylinder (i) by a correction term that is inversely proportional to the average phase of said combustion event output of cylinder (i);

calculating a control output necessary to achieve the target output for cylinder (i) at combustion event (k+1).

2. The method defined in claim 1 wherein said control output is a fuel change and the calculation of said fuel change is based on anti-correlation with the detected output and taking into account the spill-over effects from fueling other cylinders; said method further comprising the step of:

modifying said fuel change to account for the delay between calculation and application of a fuel pulse to cylinder (i) and;

calculating a fuel pulse for cylinder (i) based on the modified fuel change.

3. The method defined in claim 2 wherein said engine combustion event output is torsional acceleration.

4. The method defined in claim 1 wherein said control output is a spark change and said method further comprising the step of:

modifying said spark change to account for the delay between calculation and application of a spark change to cylinder (i) and;

calculating a spark timing for cylinder (i) based on the modified spark change.

5. A method of reducing cyclic variation in engine combustion when the air-fuel mixture is at or lean of stoichiometry, comprising a sequence of the steps of:

detecting engine torsional acceleration in cylinder (i) at a combustion event (k);

determining a target acceleration for cylinder (i) at a combustion event (k+1) based on the detected acceleration in cylinder (i) at combustion event (k);

modifying the target acceleration for cylinder (i) by a correction term that is inversely proportional to the average phase of acceleration of cylinder (i);

calculating the fuel change necessary to achieve the target acceleration for cylinder (i) at combustion event (k+1) based on anti-correlation with the detected acceleration and spill-over effects from fueling.

6. The method defined in claim 5 further comprising the step of:

modifying said fuel change to account for the delay between calculation and application of a fuel pulse to cylinder (i) and;

calculating a fuel pulse for cylinder (i) based on the modified fuel change.

7. The method defined in claim 6 wherein the said target acceleration may be expressed as:

$$targ_i(k) = targ_i(k-1) + 0.015$$

and wherein said target acceleration is modified to compensate for potential cycle to cycle oscillation of the combustion event in accordance with the equation;

$$targ_mod(k) = -C\ accel_avg(k)$$

where:

C=constant and accel_avg(k) is the average acceleration calculated in accordance with the equation;

$$accel_avg(k) = accel_avg(k-1) + 0.15$$

where:

curr_accel=detected acceleration and wherein said fuel change is based on the equation;

$$\text{lambse_mod}(k) = 0.357Gp\left[\text{targ}_i(k) + \text{targ_mod}(k) + \alpha\text{curr_accel} + \sum_j \beta_j \text{lmod}_j(k-1)\right]$$

modifying said fuel change to account for the delay between calculation and application of a fuel pulse to cylinder (i) and;

calculating a fuel pulse for cylinder (i) based on the modified fuel change.

8. The invention defined in claim 7 wherein the fuel change modification is in accordance with the equation;

$$\text{lambse}(k)=\text{lambse_targ}+\text{prev_lmod}(k)$$

where:

lambse(k) is the equivalence ratio and prev_lmod(k) is a delay of from zero to the maximum number of cylinders of the engine;

and wherein the fuel pulse is calculated in accordance with the equation;

$$\text{fuel_pulse}_i(k)=\text{cyl_air_charge}/((\text{STOICH})(\text{lambse}(k)))$$

where:

cyl_air_charge is the cylinder air charge and

STOICH is the stoichiometric air fuel ratio.

9. A method of reducing cyclic variation in engine combustion when the air-fuel mixture is at or lean of stoichiometry, comprising a sequence of the steps of:

detecting engine torsional acceleration in cylinder (i) at a combustion event (k);

determining a target acceleration for cylinder (i) at a combustion event (k+1) based on the detected acceleration in cylinder (i) at combustion event (k) and modified by a correction term that is inversely proportional to the average phase of acceleration of cylinder (i) in order to suppress cycle to cycle oscillation of all cylinder combustion events;

calculating the fuel change for cylinder (i) at combustion event (k+1) necessary to achieve said target acceleration based on anti-correlation with said detected acceleration and spill-over effects from fueling;

modifying said fuel change to account for the delay between calculation and application of a fuel pulse to cylinder (i) and;

calculating a fuel pulse for cylinder (i) based on the modified fuel change.

10. A method of reducing cyclic variation in engine combustion comprising a sequence of the steps of:

detecting engine torsional acceleration in cylinder (i) at a combustion event(k);

predicting a target acceleration for cylinder (i) at a combustion event (k+1) based on anti-correlation with the detected acceleration in cylinder (i) at combustion event (k);

modifying the target acceleration for cylinder (i) by a correction term that is inversely proportional to the average phase of acceleration of cylinder (i) to compensate for cycle to cycle oscillation of the cylinder combustion event;

calculating the fuel change necessary to achieve the target acceleration for cylinder (i) at combustion event (k+1) taking into account the spill-over effects from fueling other cylinders.

* * * * *